US011834939B2

(12) United States Patent
Kuzyaev

(10) Patent No.: US 11,834,939 B2
(45) Date of Patent: Dec. 5, 2023

(54) METHOD FOR TREATING INTERVALS OF A PRODUCING FORMATION

(71) Applicant: Salavat Anatolyevich Kuzyaev, Yekaterinburg (RU)

(72) Inventor: Salavat Anatolyevich Kuzyaev, Yekaterinburg (RU)

( * ) Notice: Subject to any disclaimer, the term of this patent is extended or adjusted under 35 U.S.C. 154(b) by 57 days.

(21) Appl. No.: 17/439,139

(22) PCT Filed: Oct. 15, 2020

(86) PCT No.: PCT/RU2020/000539
§ 371 (c)(1),
(2) Date: Sep. 14, 2021

(87) PCT Pub. No.: WO2021/086229
PCT Pub. Date: May 6, 2021

(65) Prior Publication Data

US 2022/0251933 A1 Aug. 11, 2022

(30) Foreign Application Priority Data

Nov. 1, 2019 (RU) ..... RU2019135220

(51) Int. Cl.
*E21B 43/26* (2006.01)
*E21B 33/12* (2006.01)
(Continued)

(52) U.S. Cl.
CPC ..... *E21B 43/26* (2013.01); *E21B 33/1208* (2013.01); *E21B 34/063* (2013.01); *E21B 34/14* (2013.01); *E21B 43/112* (2013.01)

(58) Field of Classification Search
CPC .... E21B 43/26; E21B 33/1208; E21B 34/063; E21B 34/14; E21B 43/112
See application file for complete search history.

(56) References Cited

U.S. PATENT DOCUMENTS 8,104,538 B2 * 1/2012 Richard ..... E21B 43/12 166/308.1
8,276,677 B2 * 10/2012 Ravensbergen ..... E21B 43/114 166/134

(Continued)

FOREIGN PATENT DOCUMENTS

| | | |
|---|---|---|
| RU | 2667171 | 9/2018 |
| RU | 185859 U1 | 12/2018 |
| RU | 2682391 | 3/2019 |

OTHER PUBLICATIONS

Machine Translation from IP.com of RU185859, Aug. 21, 2023.*

*Primary Examiner* — Aaron L Lembo
(74) *Attorney, Agent, or Firm* — Aleksandr Smushkovich

(57) ABSTRACT

The proposed technology relates to treatment of intervals of a productive formation, using a proposed device that is lowered into a wellbore to the depth of an interval, working fluid is admitted to the device's inner cavity below a lower through packer, supplied to a tubing string, through packers are activated, the wellbore annulus is isolated, the well casing is perforated, and the packers are deactivated. The device is lowered to a position between the packers, and is fixed by an anchor. Access of working fluid below the lower packer is cut off, and a hydraulic fracturing fluid is supplied, hermetically isolating the space between the packers. The device is then transferred to the next interval. The device includes the tubing sting, collar finder, upper through packer, hydraulic fracturing port, lower through packer, anchor and perforator. The technology prevents premature activation of the perforator, vibrations and damage to the packers.

16 Claims, 21 Drawing Sheets

(51) Int. Cl.

| | |
|---|---|
| ***E21B 34/06*** | (2006.01) |
| ***E21B 34/14*** | (2006.01) |
| ***E21B 43/112*** | (2006.01) |

(56) References Cited

U.S. PATENT DOCUMENTS

| | | | | |
|---|---|---|---|---|
| 9,284,823 | B2 | 3/2016 | Kratochvil et al. | |
| 9,719,334 | B2 * | 8/2017 | Jani | E21B 23/006 |
| 9,885,225 | B2 * | 2/2018 | Andersen | E21B 33/1208 |
| 10,329,889 | B2 * | 6/2019 | Jani | E21B 43/114 |
| 10,900,319 | B2 * | 1/2021 | Hrupp | E21B 33/124 |
| 10,927,648 | B2 * | 2/2021 | Stang | E21B 43/112 |
| 10,975,663 | B2 * | 4/2021 | Kratochvil | E21B 34/142 |
| 11,162,321 | B2 * | 11/2021 | Watson | E21B 34/063 |
| 2010/0282469 | A1 * | 11/2010 | Richard | E21B 43/112 166/308.1 |
| 2012/0118573 | A1 * | 5/2012 | Richard | E21B 43/14 166/308.1 |

* cited by examiner

A-A

B-B

A-A

B-B

METHOD FOR TREATING INTERVALS OF A PRODUCING FORMATION

CROSS-REFERENCE TO RELATED APPLICATIONS

This application is a U.S. national stage application of an international application PCT/RU2020/000539 filed on 15 Oct. 2020, published as WO2021086229, which international application claims priority of a Russian Federation patent application RU2019135220 filed on 1 Nov. 2019.

FIELD OF THE INVENTION

The invention relates to mining, namely, to methods and devices for processing wells of various designs and lengths, using technology of processing several intervals of a productive formation in one tripping process.

BACKGROUND OF THE INVENTION

A device for performing multi-stage hydraulic fracturing in one lifting operation is known, presented in utility model patent No. 185859 (published 20 Dec. 2018, bulletin 35).

The device for carrying out multistage hydraulic fracturing consists of tubing string (hereinafter tubing), upper selective packer with bores, frac port with hole for frac slurry injection (hereinafter fracking), perforated pipe of tubing string, lower selective packer with bores, shut-off valve and the perforating device.

The device for multi-stage hydraulic fracturing is lowered into a well with several productive formations, the perforating device is adjusted to lower interval of fracking, the fluid is pumped through the tubing string, which, coming from the frac port through the hole for pumping hydraulic fracturing fluid reservoir, activates upper and lower selective packers. With increasing pressure in tubing string, pressure in inter-packer space also increases and the liquid is supplied through the holes of the perforated pipe and the bore of the lower selective packer through the shut-off valve to the perforating device. The perforating device presented in the patent description contains a housing into which a piston with a punch is inserted.

Under the pressure, working fluid drives a piston with a punch that perforates a casing pipe. Pressure in the tubing string is relieved and the upper and lower selective packers are brought to the transport position. Device is lowered so that the inter-packer space is located opposite the perforated interval of the hydraulic fracturing. Gradually increasing the pressure in the tubing string, the upper and lower selective packers are activated. At the moment when pressure in shut-off valve equals a value P1 (where P1—pressure shut-off valve actuating pressure), bores are overlapped to avoid transmitting a pressure exceeding P1 value to the perforating device. After activation of pressure shut-off valve, scheduled hydraulic fracturing (injection of fluid and propping agent) is performed in this interval. After the end of this stage of hydraulic fracturing, the pressure in the tubing string is relieved, the packers are transferred to the transport position, and the device is lifted to the next higher interval of hydraulic fracturing.

Disadvantage of the known device is low reliability and accident rate due to the lack of reliable fixation with activated cup packers, especially during hydraulic fracturing. High pressure supply can lead to linear lengthening of the tubing, device movement and vibration, which contributes to premature damage to the elastic collars of the cup packers pressed against the walls of the production column.

Also, the disadvantage of the device is its accident rate associated with the perforation of the production column outside the technological processing interval. As indicated in the patent description, operation of the perforating device is performed at a pressure of 200 atm. Subsequent activation of selective packers to separate the perforated interval and activate the shut-off valve is performed at a pressure of up to 220 atm.

In this moment, the perforating device is located outside of productive formation processing interval and, being activated at a pressure greater than the perforation pressure, can pierce the column outside the processed intervals, which leads to damage to the casing and depressurization.

Disadvantage of the method of hydraulic fracturing, information about which is given in the patent description, is low manufacturability.

The closest analogues to the presented technical solutions are method and variants of the device presented in the patent U.S. Pat. No. 9,284,823 (publ. 15 Mar. 2016) "Combined perforating tool".

The well-known combined device is designed for development of several productive formations, in a way that includes perforation of watered wells and hydraulic fracturing in one tripping process. The known device includes a hydraulic fracturing port, a drive mechanism of a boring machine with a reinforcing node, a boring machine and cup packers. At the lower end of a flexible tubing, a lower cup packer is installed, while its expanding end is directed into the well and prevents leakage of fluid of the watered well up between the casing string and the device. Above, a bypass mechanism is installed to bypass the borehole fluid around the device, consisting of a sliding housing with spring elements that engage with the inner part of the borehole.

When the lower packer is activated and spring elements of the housing of the bypass mechanism that prevents moving the downhole fluid in the annular space during movement of the tool up is fixed, held sliding body opens a hole through which fluid of the flooded well penetrates into the annular space and moves up to bypass the activated packer.

After that a perforating boring machine (herein called 'perforator'), its drive mechanism with a reinforcing node, the upper cup packers with expanding ends, which are directed to the hydraulic fracturing port installed on top, is installed up coiled tubing. A valve assembly is installed between the upper cup packer and the hydraulic fracturing port, which cuts off fluid to the boring machine during hydraulic fracturing.

A well-known method of perforating the casing of a well and subsequent hydraulic fracturing consists in lowering the tool into the well, then supplying working fluid to actuate drive mechanism of the boring machine, perforating the casing. After that, the device is moved down the well to align the hydraulic fracturing port with the perforated section of the casing. After that, only upper cup packer is activated to isolate the bottom of the hydraulic fracturing port, activate the valve assembly and disable drive mechanism of the boring machine. After that, the fluid is fed to the hydraulic fracturing port and hydraulic fracturing is carried out.

Low efficiency is its disadvantage, since the hydraulic fracturing fluid under pressure can penetrate not only into the productive formation, but also spread up through annulus, which can damage the production string and result in device sticking.

The disadvantage of the device is design complexity. In addition, the device is equipped with only one packer installed below the fracturing port (below the formation interval), and therefore cannot provide a sealed separation of processing interval during fracturing. In addition, sealing the processing interval with a single packer leads to an uneven distribution of the load on the device when pressure is applied to the packer, which reduces reliability of the device.

OBJECTIVES AND SUMMARY OF THE INVENTION

The objective of the presented technical solutions is to create an effective method for safe processing of a productive formation with the ability to process multiple intervals of a productive formation in one tripping process using a simple and reliable device.

The technical result is that the inventive technology of processing a productive formation includes perforation and subsequent hydraulic fracturing while ensuring sealed isolation of each perforation interval.

The technical result is that the inventive technology also includes separation of the hydraulic fracturing interval, which is provided on both sides with a reliable fixation of the device in a well and that the control of all technological operations is provided by a reliable and simple device.

The technical result is achieved by the fact that the method of processing a productive formation in one tripping process includes lowering into the well of a device containing a hydraulic fracturing port, through-pass packers, an anchor and a perforator. Then, the device is positioned to the depth of the specified productive formation interval. After that working fluid is supplied to the internal cavity of the device under the lower packer, supply working fluid to the tubing and, activating the packers, separate the inter-packer annulus. Then, the perforator is brought to the working position and the well casing is perforated. After perforation of the productive formation interval, pressure of the working fluid is reduced and the pass-through packers are deactivated. Then, the device is lowered to the position at which the perforated interval of the productive formation is located between the packers, and the device is fixed in the well. The following actions block the access of fluid to internal cavity of the device under the lower pass-through packer, supply hydraulic fracturing fluid under pressure, hermetically isolating the inter-packer space, and hydraulic fracturing is performed. Upon completion of hydraulic fracturing, the device is transferred to the transport position and lifted until the next interval of the productive formation to be processed.

The device can be positioned at the processing intervals using a mechanical collar locator.

Before hydraulic fracturing, the device is fixed in the well using a mechanical anchor to block the access of hydraulic fracturing fluid supplied under pressure to the internal cavity of the device under the lower packer (FIG. 4).

Upon completion of the processing of productive formation interval, the mechanical anchor is deactivated to allow the device to move to the next interval of the productive formation to be processed.

The technical result is also achieved by the fact that the first version of the device for implementing the above method of processing several intervals of the productive formation in one tripping process contains the main components of the device installed on the tubing as part of:

- upper and lower pass-through packers for separating and sealing the inter-packer space,
- hydraulic fracturing port installed between the upper and lower pass-through packers,
- the valve located under the lower packer,
- a mechanical anchor rigidly connected to a mechanical perforator.

The hydraulic fracturing port housing contains a partition separating it into two parts. One part of the housing of the hydraulic fracturing port has hydraulic fracturing holes. Another part of the housing has radial holes for hydraulic connection of the internal cavity of the device under the lower pass-through packer with the inter-packer annulus and there is a first hollow rod passing through the internal cavity of the lower pass-through packer.

The valve is a part of the housing and a movable second hollow rod, which are provided with radial holes.

Fixing the device in the well with a mechanical anchor establishes a tight contact between all the units of the device located under the hydraulic fracturing port.

The device is additionally equipped with a mechanical collar locator, which can be installed above the upper packer, and is designed to position the device at a given interval of the productive formation.

Pass-through packers may contain cup sealing elements that open in the direction of the hydraulic fracturing port.

Before fixing the device with a mechanical anchor before supplying working fluid to the tubing, the first hollow rod interacting with the hydraulic fracturing port is connected to the lower pass-through packer by a destructible element.

The second hollow rod in the lower part is made with a smaller diameter and before fixing the device with a mechanical anchor before supplying working fluid to the tubing is connected to the valve housing by a destructible element.

The lower part of the hollow valve rod, made with a smaller diameter, determines the size of the rod stroke when the radial holes of the housing and the stem overlap or combine.

A housing partition of the frac port is made with a recess for the first hollow rod providing overlapping of radial holes of frac port in order to separate internal cavity of the device below the lower packer from inter-packer annulus.

A mechanical anchor can include an anchor and friction elements.

Tight contact between all units of the device located under the hydraulic fracturing port, established when the device is fixed in the well, is maintained until the mechanical anchor is deactivated.

The technical result is also achieved by the fact that the second version of the device for implementing the above method of processing several intervals of the productive formation in one tripping process contains the main components of the device installed on the tubing as part of:

- upper and lower pass-through packers for separating and sealing the inter-packer space,
- a hydraulic fracturing port installed between the upper and lower pass-through packers,
- a mechanical anchor rigidly connected to a mechanical perforator.

A port housing of the hydraulic fracturing port contains a partition separating it into two parts. One part of the port housing has hydraulic fracturing holes. Another part of the port housing has port radial holes for hydraulic connection of the internal cavity of the device under the lower pass-through packer with the inter-packer annulus and there is a hollow rod passing through the internal cavity of the lower pass-through packer.

Fixing the device in the well with a mechanical anchor establishes a tight contact between all the units of the device located under the hydraulic fracturing port.

The device is additionally equipped with a mechanical collar locator, which can be installed above the upper packer, and is designed to position the device at a given interval of the productive formation.

The pass-through packers may contain cup sealing elements that open toward the direction of the hydraulic fracturing port.

Before fixing the device with a mechanical anchor before supplying working fluid to the tubing, the hollow rod interacting with the hydraulic fracturing port is connected to the lower pass-through packer by a destructible element.

A housing partition of the frac port is made with a recess for the hollow rod providing for overlapping of the port radial holes in order to separate the internal cavity of the device below the lower packer from inter-packer annulus.

A mechanical anchor can include an anchor and friction elements.

Tight contact between all units of the device located under the hydraulic fracturing port, established when the device is fixed in the well, is maintained until the mechanical anchor is deactivated.

DESCRIPTION OF DRAWINGS OF THE INVENTION

DESCRIPTION OF PREFERRED EMBODIMENTS OF THE INVENTION

Figure 1:
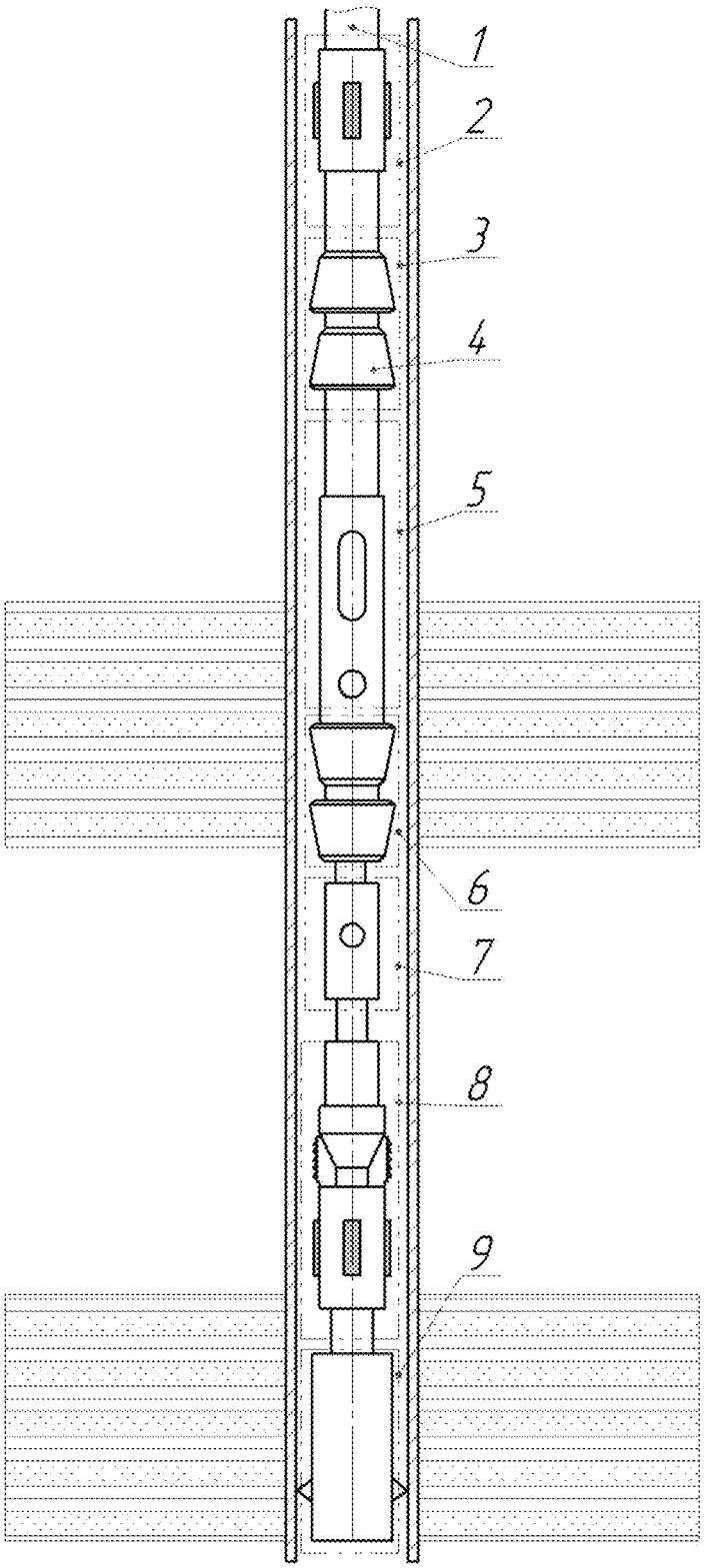
FIG. 1 shows a general view of the first version of the device.
Figure 2:
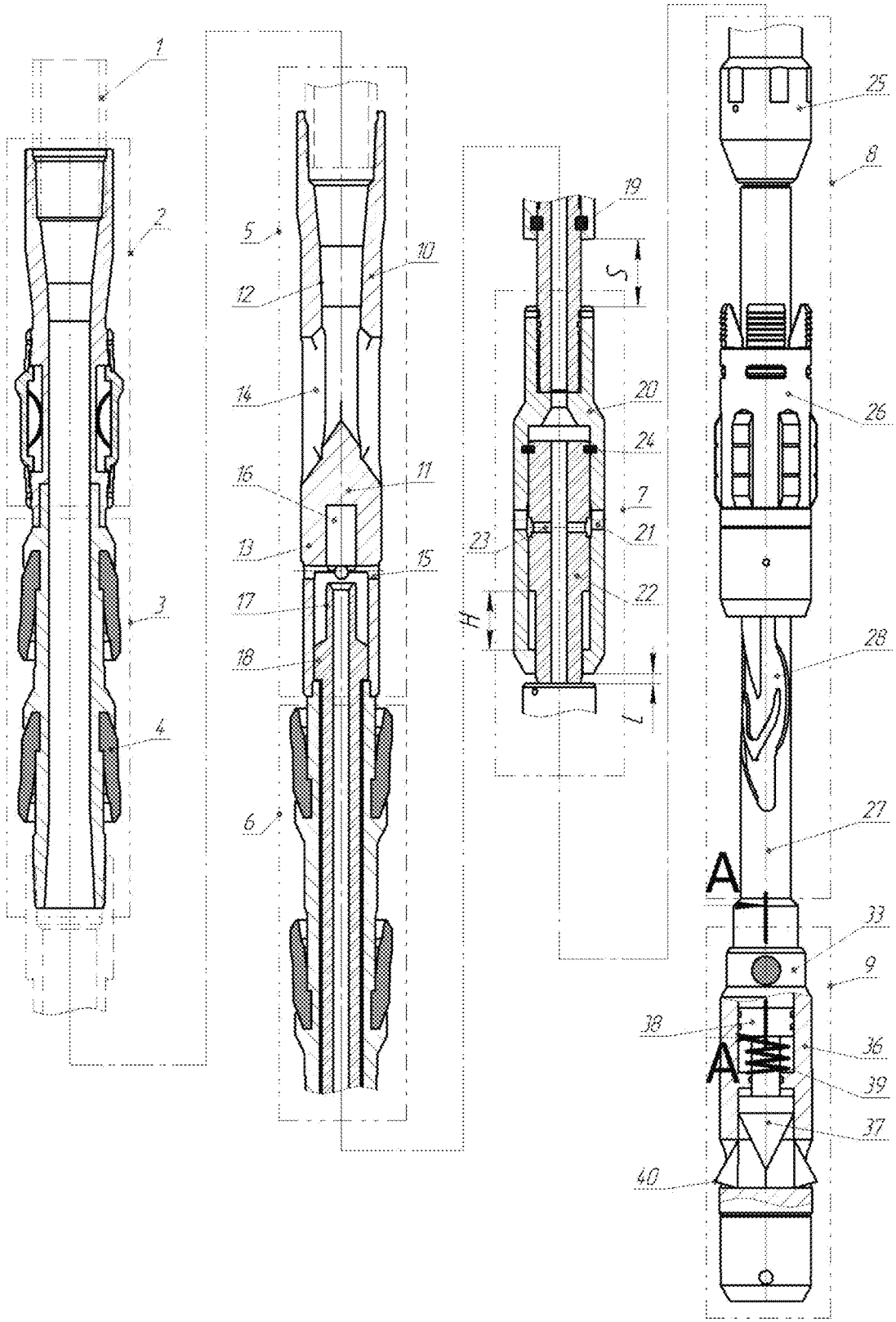
FIG. 2 shows a general view of the first version (axial section) of the device when going into a well.

The first version of the device is used mainly in inclined and horizontal wells and contains a mechanical collar locator 2, an upper through-pass packer 3 with two cup sealing elements 4, a hydraulic fracturing port 5, a lower through-pass packer 6, a valve 7, a mechanical anchor 8 and a perforator 9 mounted (from top to bottom) on a tubing string 1 (herein also called 'tubing'). Cup elements 4 of the upper and lower packers are directed to the hydraulic fracturing port 5 (FIG. 1, FIG. 2).

The hydraulic fracturing port 5 contains a hollow cylindrical housing 10, divided by a partition 11 into upper 12 and lower 13 parts, and rigidly connected to the lower packer 6. In the upper part 12 of the housing 10, hydraulic fracturing holes 14 are made, and in the lower part 13 of the housing 10, radial holes 15 are made. A recess 16 is made in the partition 11.

In the lower part 13 of the housing 10 with the possibility of axial movement, a first hollow rod 17 is installed, on the outer surface of which an annular protrusion 18 is made, hermetically covering the cavity in the lower part 13 of the housing 10. The hollow rod 17 passes through the pass-through lower packer 6 and is fastened to it by a destructible element 19.

The valve 7 contains a hollow housing 20 with radial holes 21. A cavity of the housing 20 accommodates a second hollow rod 22 with valve rod radial holes 23 with the possibility of axial movement and is additionally fastened to the housing by a destructible element 24. The lower part of the rod 22 is made with a smaller diameter and determines the stroke "H" of the rod 22 when the radial holes 23 and 21 are combined or overlap, which corresponds to the open or closed position of the valve 7.

Figure 7:
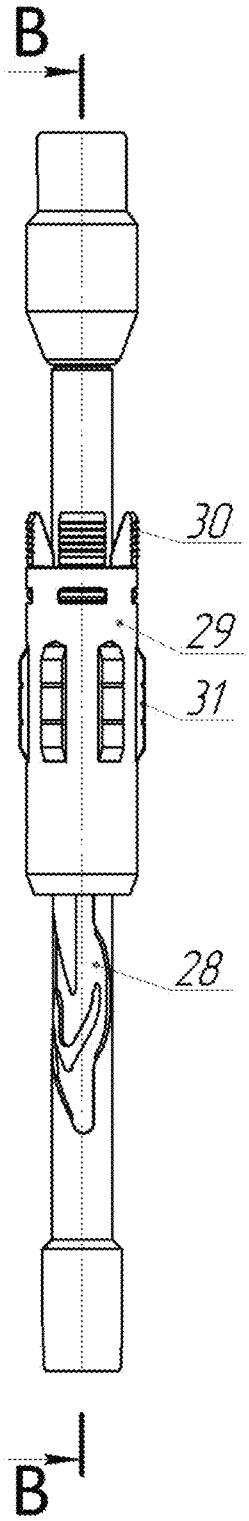
FIG. 7 shows a general view of the mechanic anchor of the first version of the device.
Figure 8:
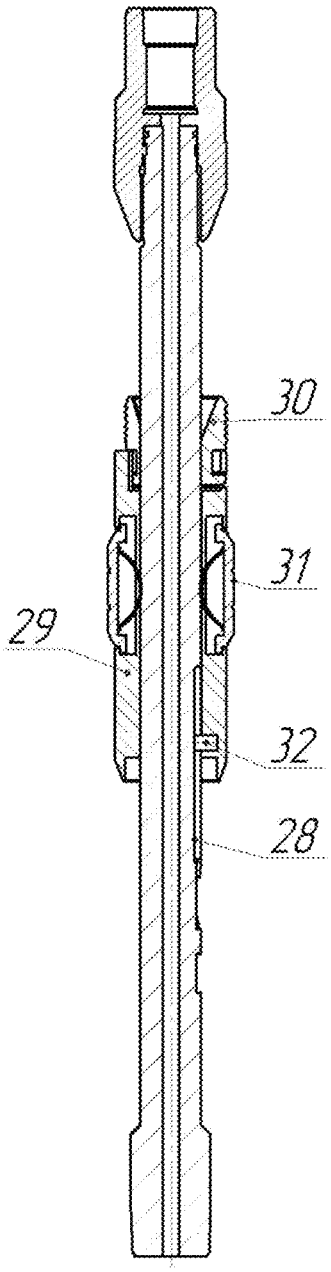
FIG. 8 shows an axial section of the mechanical anchor of the first version of the device.
Figure 9:
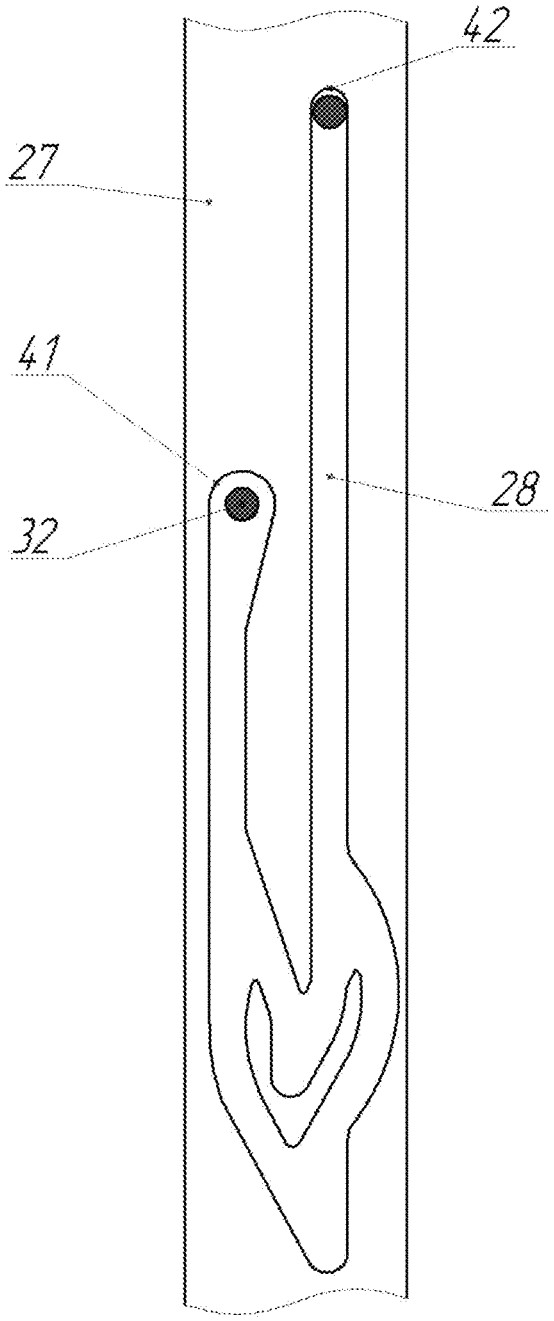
FIG. 9 shows a general view of the first version (axial section).

The rod 22 is rigidly connected to the straight way mechanical anchor 8, which contains a cone 25, a friction unit 26 and a hollow barrel 27, rigidly connected to the perforator 9. A groove 28 is made on the outer surface of the barrel 27. The friction unit contains a housing 29, anchors 30 and friction elements 31 fixed in it. A pin 32 is placed inside the housing, in contact with the groove 28 (FIGS. 7 and 8).

Figure 6:
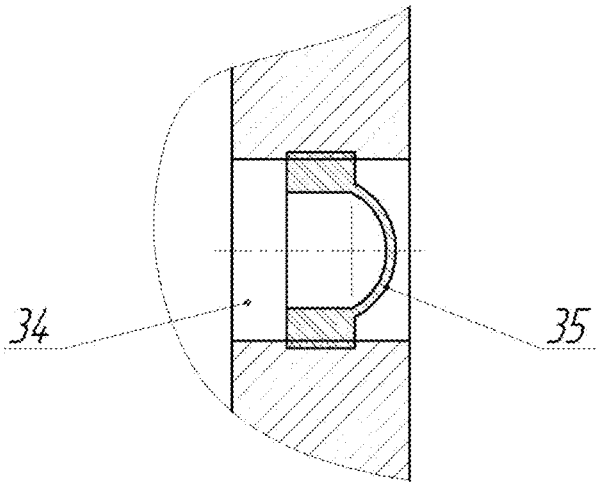
FIG. 6 shows an axial section of the membrane element of the first version of the device.

The device is additionally equipped with a membrane element 33 for depressurizing the units located below the lower pass-through packer 6, which is located between the hollow barrel 27 of the anchor 8 and the mechanical perforator 9 and is rigidly connected to them. The membrane element is a part of a housing of the perforator with an opening 34 hermetically sealed by a membrane 35. Also, the membrane element 33 can be located in the upper part of the housing of the perforator 9 (FIG. 6).

The perforator 9 is equipped with a wedge mechanism 37, a piston 38, a return spring 39, and destructive elements 40 installed in the housing 36 and is connected to the mechanical anchor 8.

Operation of Preferred Embodiments of the Invention

The FIRST VERSION of the device functions as follows:

Before lowering the device into the well, it is assembled at the mouth, installing on the tubing 1 from the bottom up a perforator 9, a mechanical anchor 8, a valve 7, a lower packer 6, a hydraulic fracturing port 5, an upper packer 3, a mechanical collar locator 2, designed to connect the device to the depth of a given formation interval. The device can have mechanical collar locator A 1025-2, presented in the catalog "Tools for current and major repairs of wells", p. 31 (<https://www.slb.ru/upload/iblock/d8e/katalog-instrumentov-dla-tekushego-i-kapitalnogo-remonta-skvajin.pdf>).

When lowering into the well casing, the perforator 9, upper 3 and lower 6 straight way packers are in the transport position, the first hollow rod 17 is in the lower position and is fixed from axial movement by destructible element 19. The radial holes 15 are open. The second hollow rod 22 of the valve 7 is set in a position in which the holes 21 and 23 are combined, and is fixed by the destructible element 24. The anchor 8 is not activated, its pin 32 is engaged with the groove 28 of the hollow barrel 27 in the lower position 41.

If it is necessary to process several intervals, the device is positioned so that the perforator 9 is at the level of the lowest interval of the productive formation. Axial movements of the device activate the mechanical anchor 8, while the pin 32, which is engaged with the groove 28, moves along it to the position 42.

Figure 3:
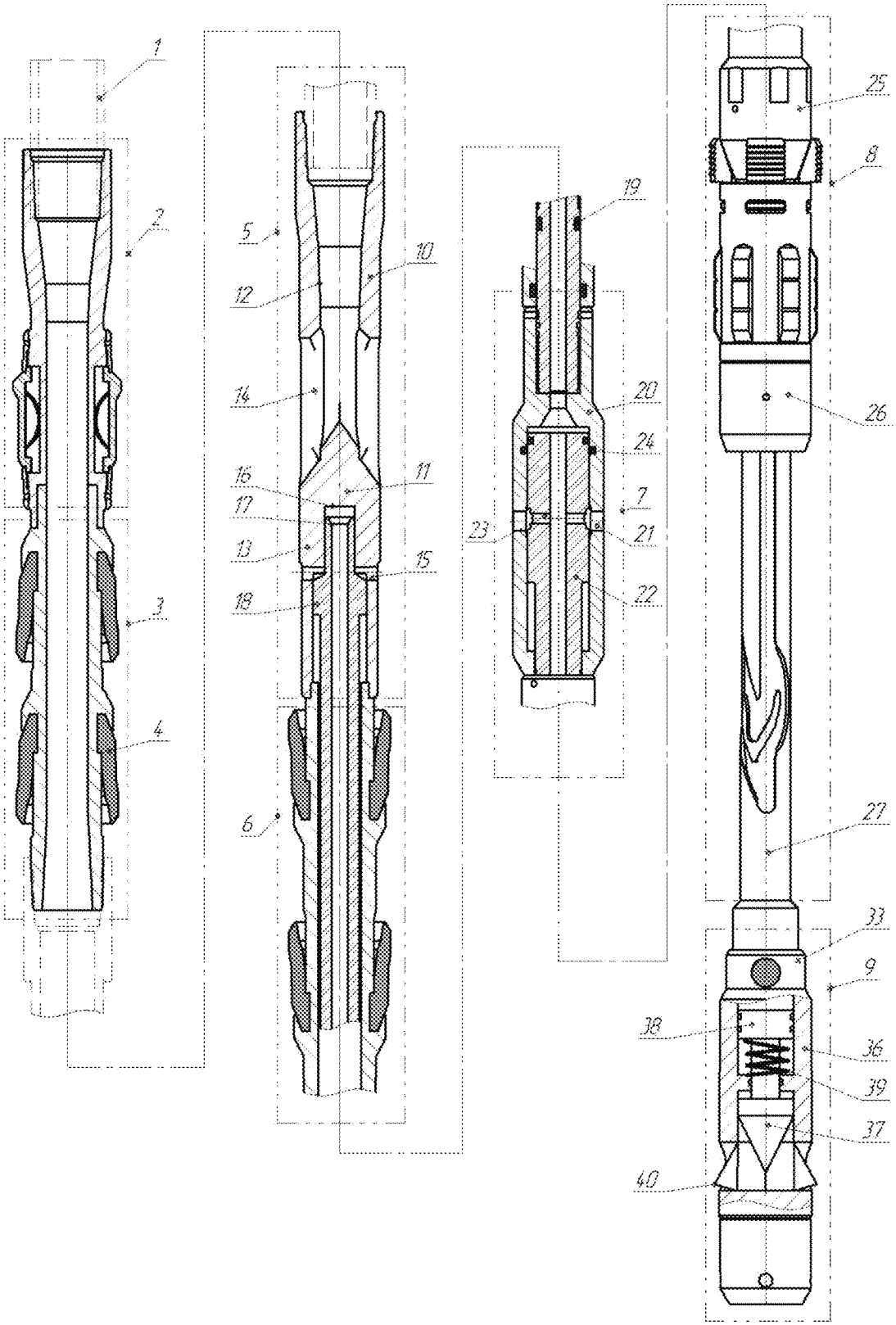
FIG. 3 shows a general view of the first version (axial section) when the device is fixed in the well with a mechanical anchor in a position where the radial holes of the hydraulic fracturing port are blocked.

Under the weight of the tubing 1 and the device, the elements 19 and 24 are destroyed, the lower pass-through packer 6 moves to the distance "S" and connects to the valve 7 to form a tight contact. Housing 20 of the valve 7 moves to the distance "L" and contacts the anchor 8 (FIG. 3), while the housing 10 of the hydraulic fracturing port 5 moves down, the hollow rod 17 enters the recess 16 made in the partition 13, blocks the radial holes 15 and the access of the working fluid to the perforator.

Figure 4:
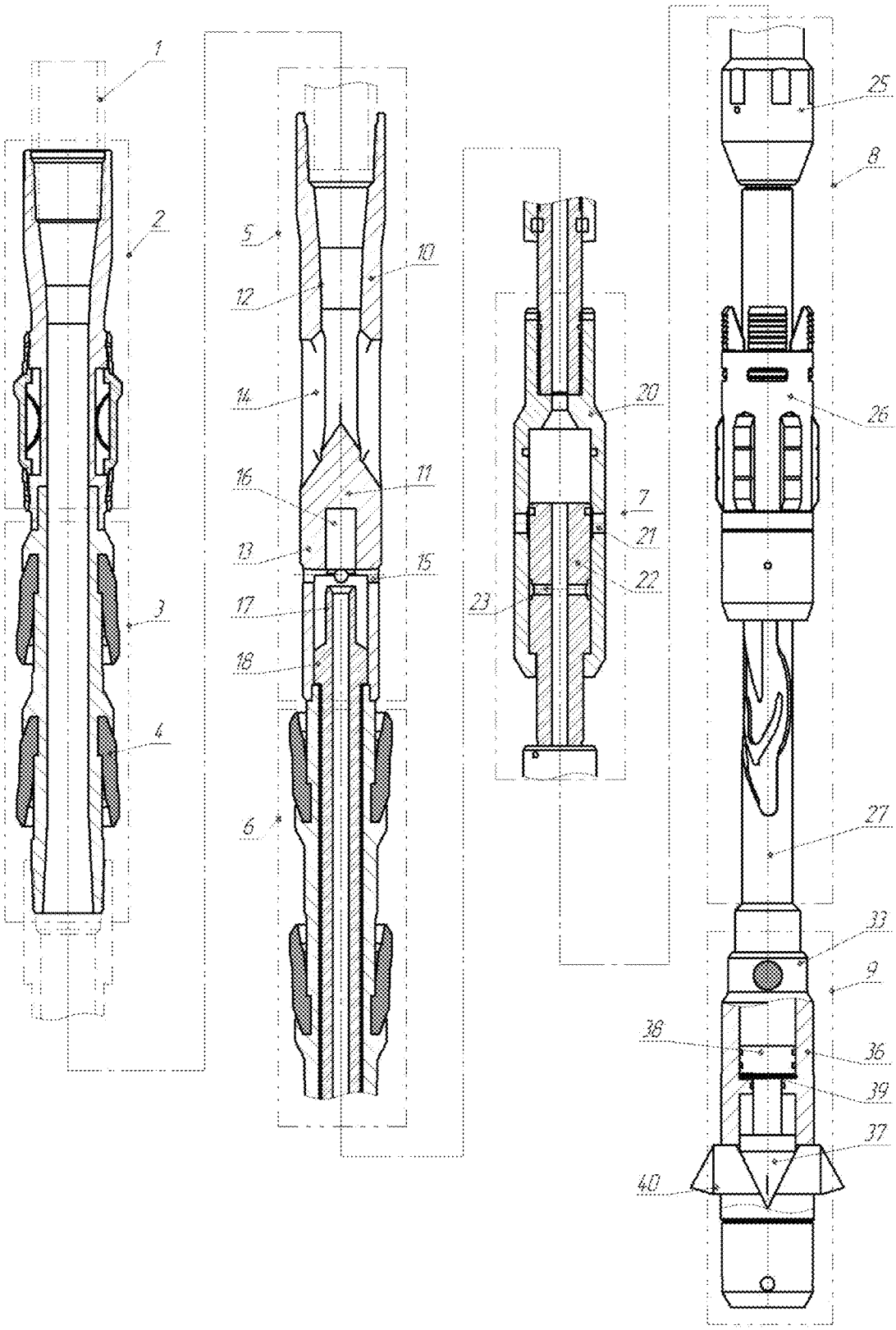
FIG. 4 shows a general view of the first version (axial section) of the device when perforating well casing.

To transfer the perforator to the working position, the through-pass mechanical anchor 8 is deactivated by axial movements of the device, while the hollow rod 22 moves down, blocking the radial holes 21, 23, and access to the annulus. Hollow rod 17 comes out of the recess 16, opening the holes 15 and providing access of the working fluid from an annular inter-packer space to the inner cavity of the device and to the perforator (FIG. 4). An annular inter-packer space (herein also called 'inter-packer annulus') is defined as a space between the outer surface of the device and the inner sidewall surface of the well casing, vertically limited by positions of the upper packer and the lower packer.

After that, the pump unit located on the surface supplies working fluid under pressure into the tubing 1. Working fluid enters the annular inter-packer space through the windows 14 of the hydraulic fracturing port 5, activating the cup sealing elements 4 and providing pressure of the working fluid in the annular inter-packer space.

Working fluid under pressure enters through the holes 15 into the inner cavity of the rod 17, rod 22, through-hole 27, anchor 8 and into the perforator 9, while the destructive elements 40 of the perforator 9 are activated by means of the wedge 37 and spring mechanism 39, and the well casing is perforated.

After perforation, supply of the working fluid under pressure stops. The perforator 9 is moved to the transport position, upper and lower packers are deactivated and the device is moved in the well until the perforated interval of the formation is set between the upper 3 and lower 6 pass-through packers.

Figure 5:
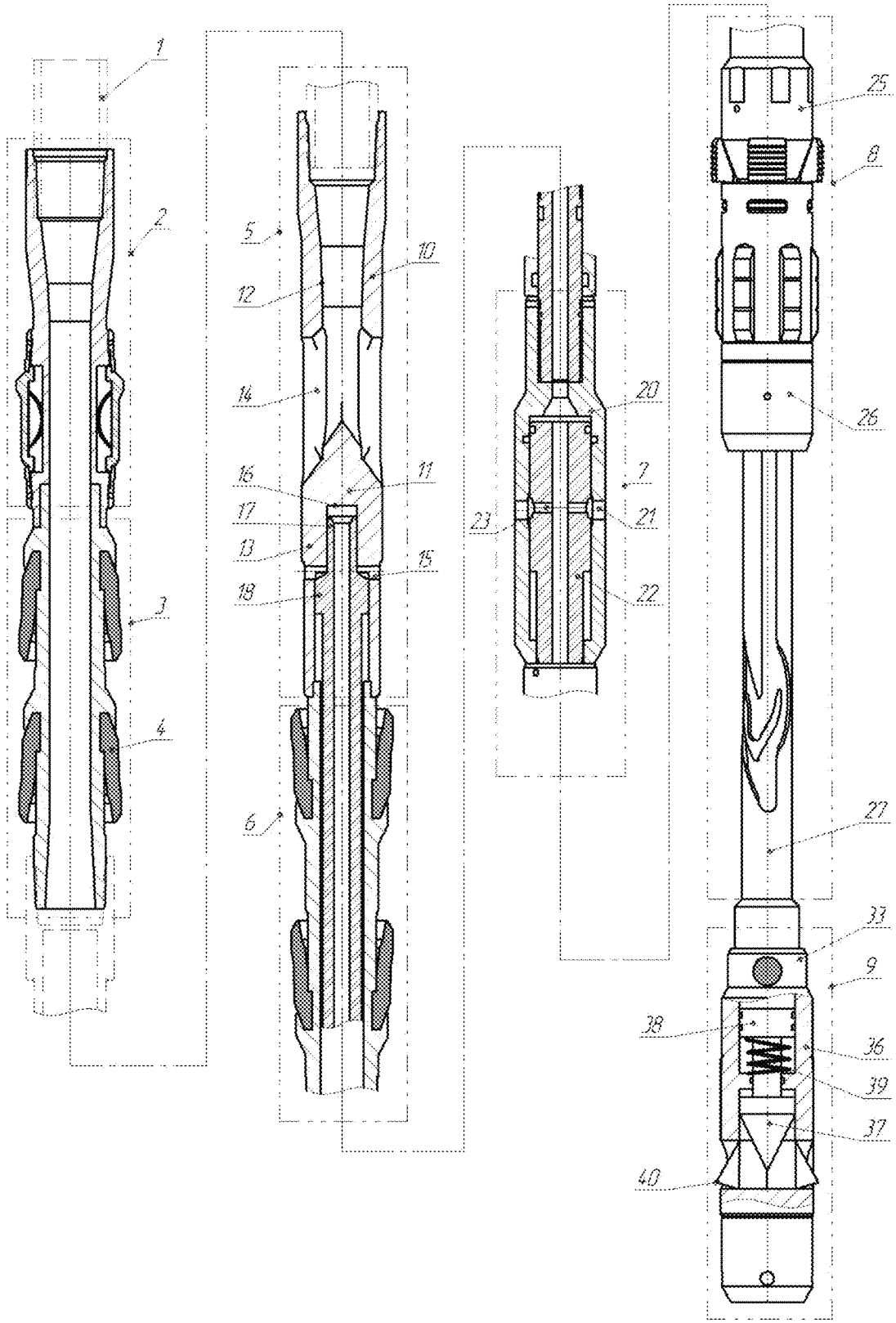
FIG. 5 shows a general view of the first version (axial section) of the device during hydraulic fracturing.

Next, the device is fixed in the well with the mechanical anchor 8, while the rod 17 enters the recess 16, blocks the holes 15 and access to the internal cavity of the device under the lower pass-through packer. The rod 22 is in a position in which the holes 21 and 23 are combined, blocking the hydraulic communication with the annulus, which corresponds to the position of the hydraulic fracturing (FIG. 5).

After that, the tubing 1 is fed under the pressure with the fracture fluid, the cup seal elements 4 directed toward the frac port 5 open and hermetically aligned to the inner wall of the casing string, isolating the inter-packers annulus space, and hydraulic fracturing takes place. Upon completion of hydraulic fracturing, the pressure in the well is released, and the packers 3 and 6 are deactivated. Axial movement of the device deactivates the anchor 8.

If it is necessary to process several intervals, the device is moved in the direction of the wellhead to the next interval of the productive formation and its processing is carried out using the device in the above sequence of actions.

After perforation at the last interval of the productive formation, the pressure of the working fluid is increased to depressurize the membrane element 33. When the membrane 35 is destroyed, hole 34 opens, providing access to the fluid located in the internal cavities of the device to the annular space under the device.

Hydraulic fracturing is performed at the last interval of the formation and the device is lifted from the well. Fluid from the annular inter-packer space through the hole 15, enters into the internal cavity of the device below the lower packer 6, the hole 34 and into the annular space under the device, whereby the elastic elements 4 of the lower packer 6 is not stressed or prevent lifting of the device from the well.

The SECOND VERSION of the device has a simpler design compared to the first version of the device and is used for processing of, mainly, shallow wells.

Figure 12:
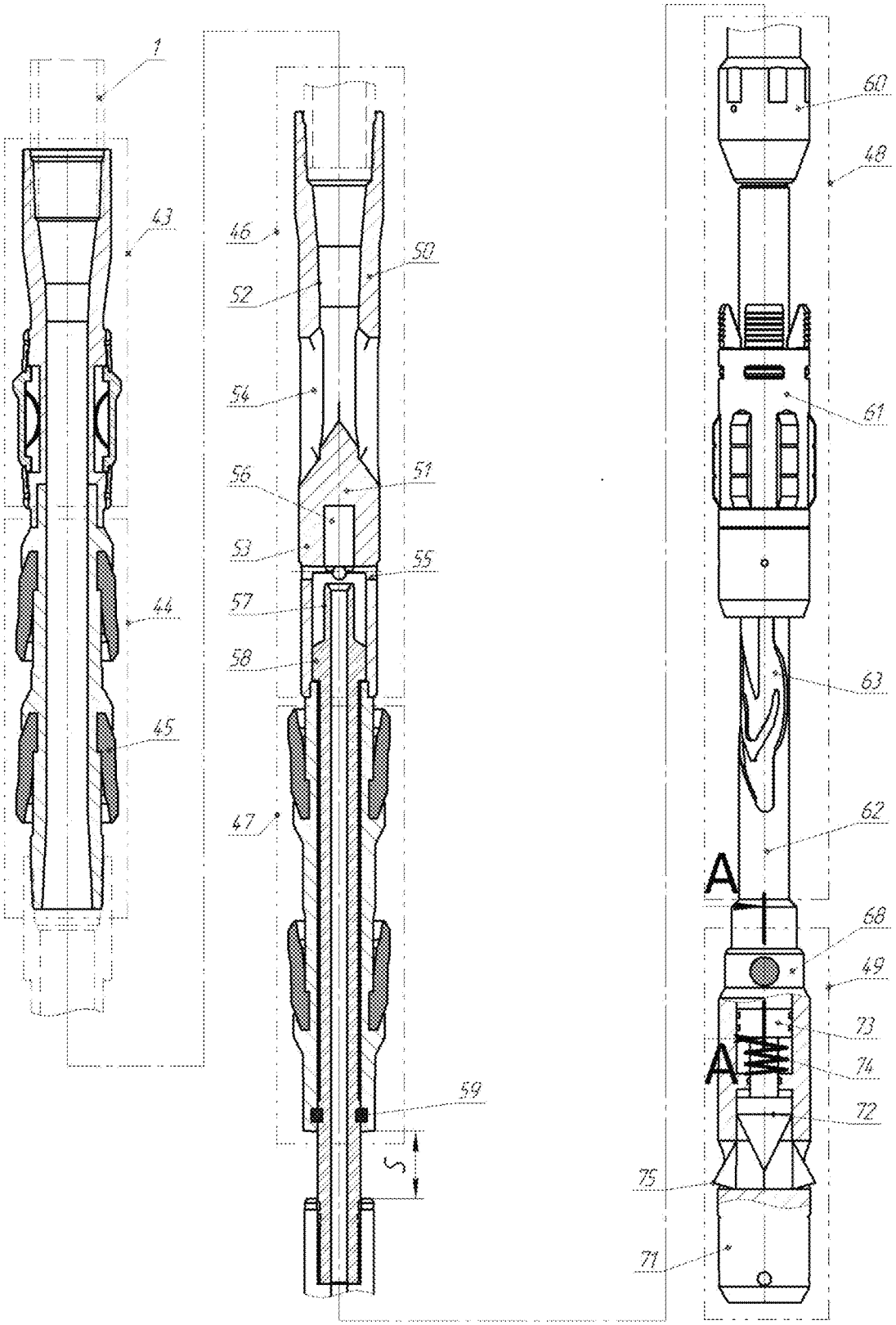
FIG. 12 shows a general view of the second version (axial section) of the device when going into a well.

The second version of the device contains a mechanical collar locator 43, an upper pass-through packer 44 with two cup sealing elements 45, a hydraulic fracturing port 46, a lower pass-through packer 47, a mechanical anchor 48 and a perforator 49 mounted on the tubing 1 (from top to the bottom) (FIG. 12).

The hydraulic fracturing port 46 contains a hollow cylindrical housing 50, divided by a partition 51 into an upper 52 and a lower 53 parts, and rigidly connected to the lower packer 47. The upper part 52 of the housing 50 has hydraulic fracturing holes 54, and the lower part 53 has radial holes 55. A recess 56 is made in the partition 51 of the housing 50.

In the lower part 53 of the housing 50, with the possibility of axial movement, a hollow rod 57 is installed, located in the pass-through lower packer 47, and fastened to its housing by a destructible element 59. On the outer surface of the rod 57, an annular protrusion 58 is made, hermetically covering the cavity in the lower part 53 of the housing 50, ensuring the fluid flow into the cavity of the rod 57.

Figure 17:
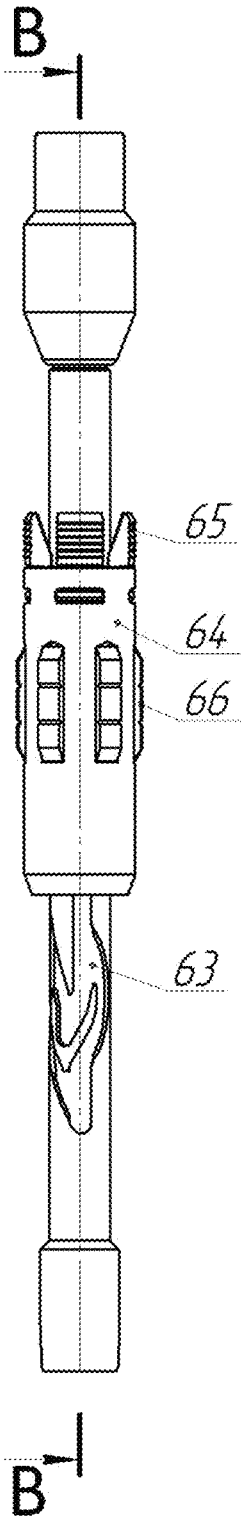
FIG. 17 shows a general view of the mechanic anchor of the second version of the device.
Figure 18:
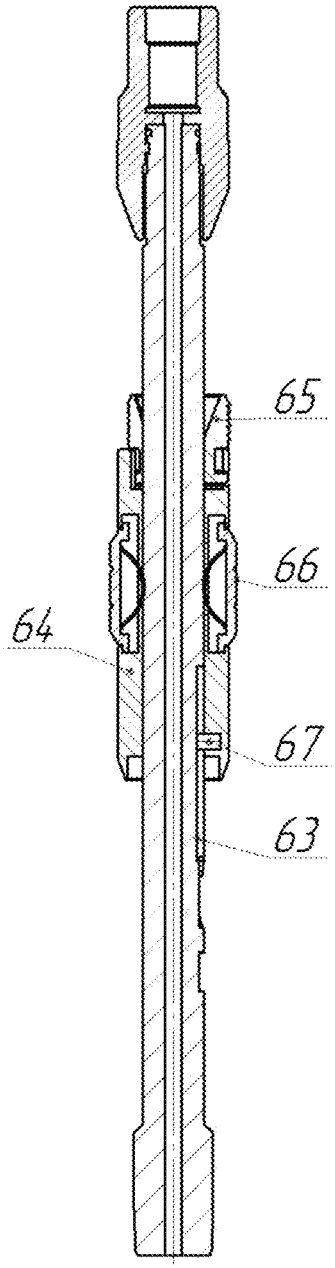
FIG. 18 shows an axial section of the mechanical anchor of the second version of the device.
Figure 19:
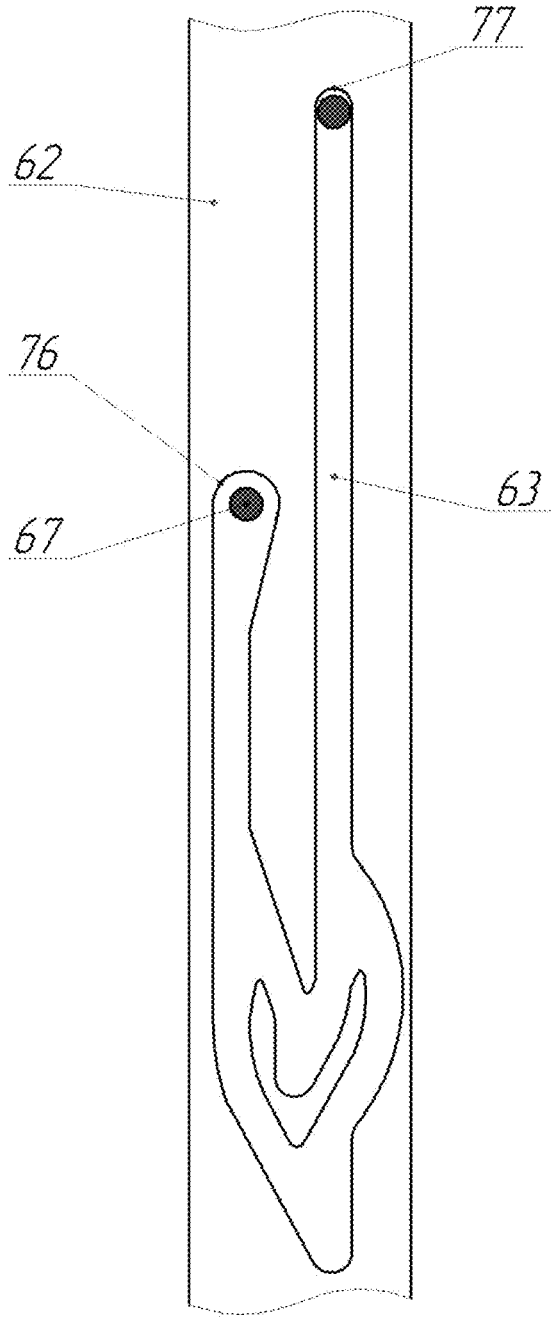
FIG. 19 shows a groove made on the anchor tube of the second version of the device.

The rod 57 is rigidly connected to a mechanical anchor 48 containing a cone 60, a friction unit 61 and a hollow barrel 62 rigidly connected to the perforator 49. A groove 63 is made on the outer surface of the barrel 62. The friction unit contains a housing 64, anchors 65 and friction elements 66 fixed in it. Inside the housing there is a pin 67 in contact with the groove 63 (FIGS. 17 and 18).

Figure 16:
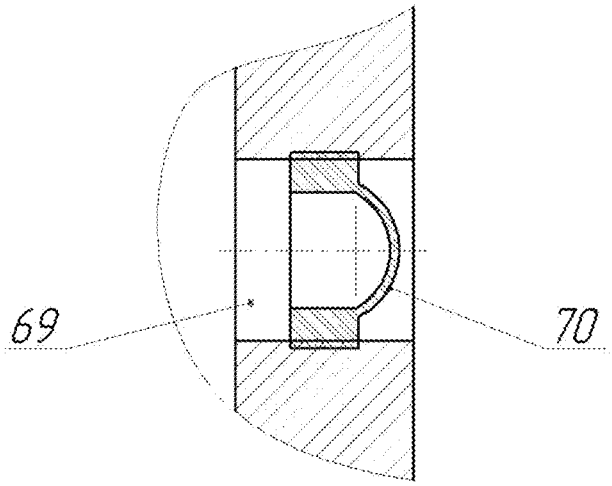
FIG. 16 shows an axial section of the membrane element of the second version of the device.

The device is additionally equipped with a membrane element 68 for depressurization of units located below the lower packer 47. An opening 69, hermetically sealed by a membrane 70, is made in the housing of the membrane element. The element can be located, for example, above the perforator 49 (FIG. 16).

The perforator 49 is equipped with a wedge mechanism 72, a piston 73, a return spring 74, and destructive elements 75 installed in the housing 71 and is connected to the mechanical anchor 48.

The SECOND VERSION of the device functions as follows:

Before lowering into the borehole the device is assembled at the wellhead (bottom-up) and comprises the perforator 49, mechanical anchor 48, lower packer 47, frac port 46, upper packer 44 and mechanical collar locator 43, which is designed for positioning the device at a depth of the specified interval of the layer to be processed.

When lowering into the well, the perforator 49, upper 44 and lower 47 straight way packers are in the transport position, the hollow rod 57 is in the lower position and is fixed from axial movement by the destructible element 59, and the holes 55 are open. The anchor elements 65 of the anchor 48 are not activated, and the pin 67 is in position 76.

Figure 13:
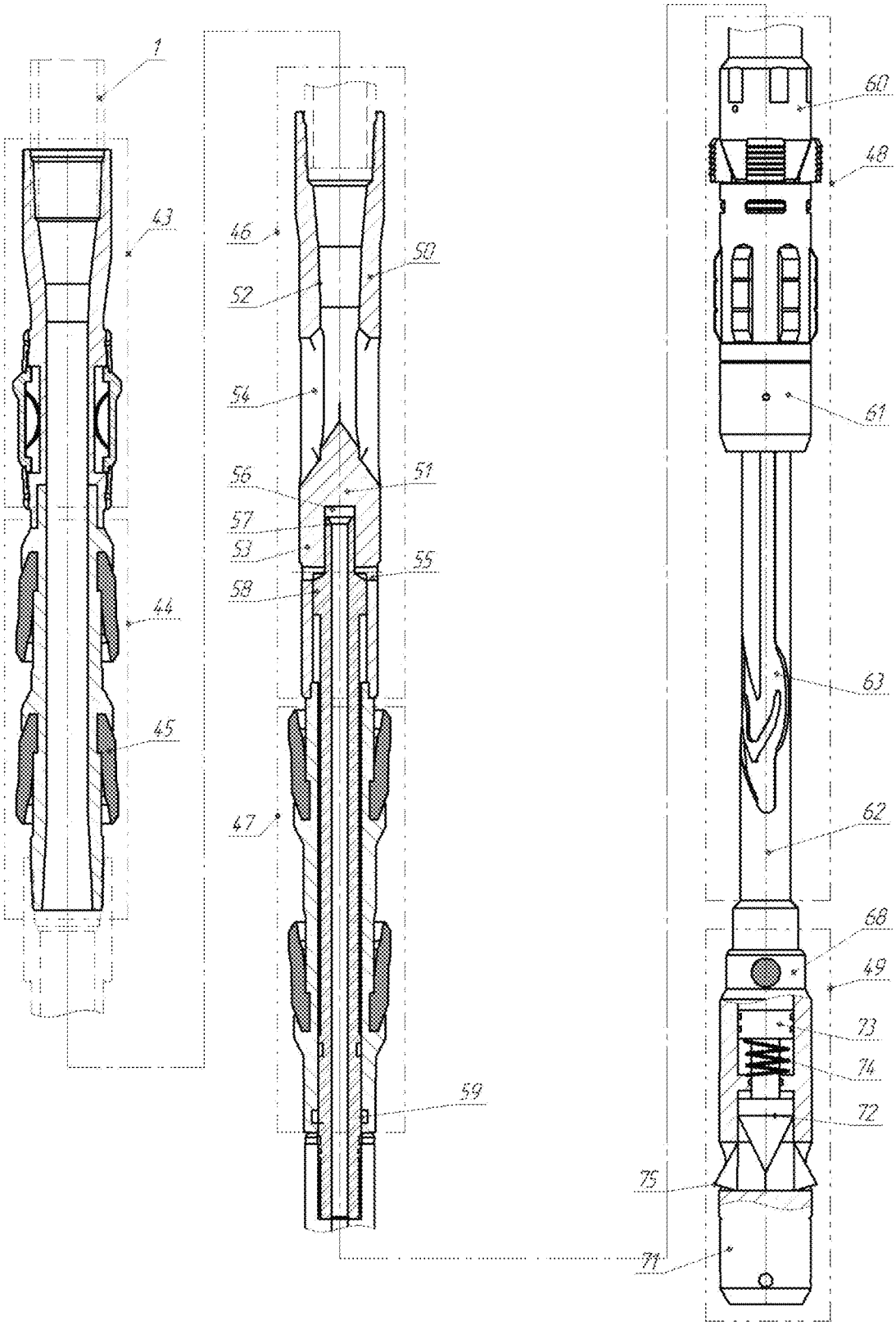
FIG. 13 shows a general view of the second version (axial section) when the device is fixed in the well with a mechanical anchor in a position where the radial holes of the hydraulic fracturing port are blocked.
Figure 14:
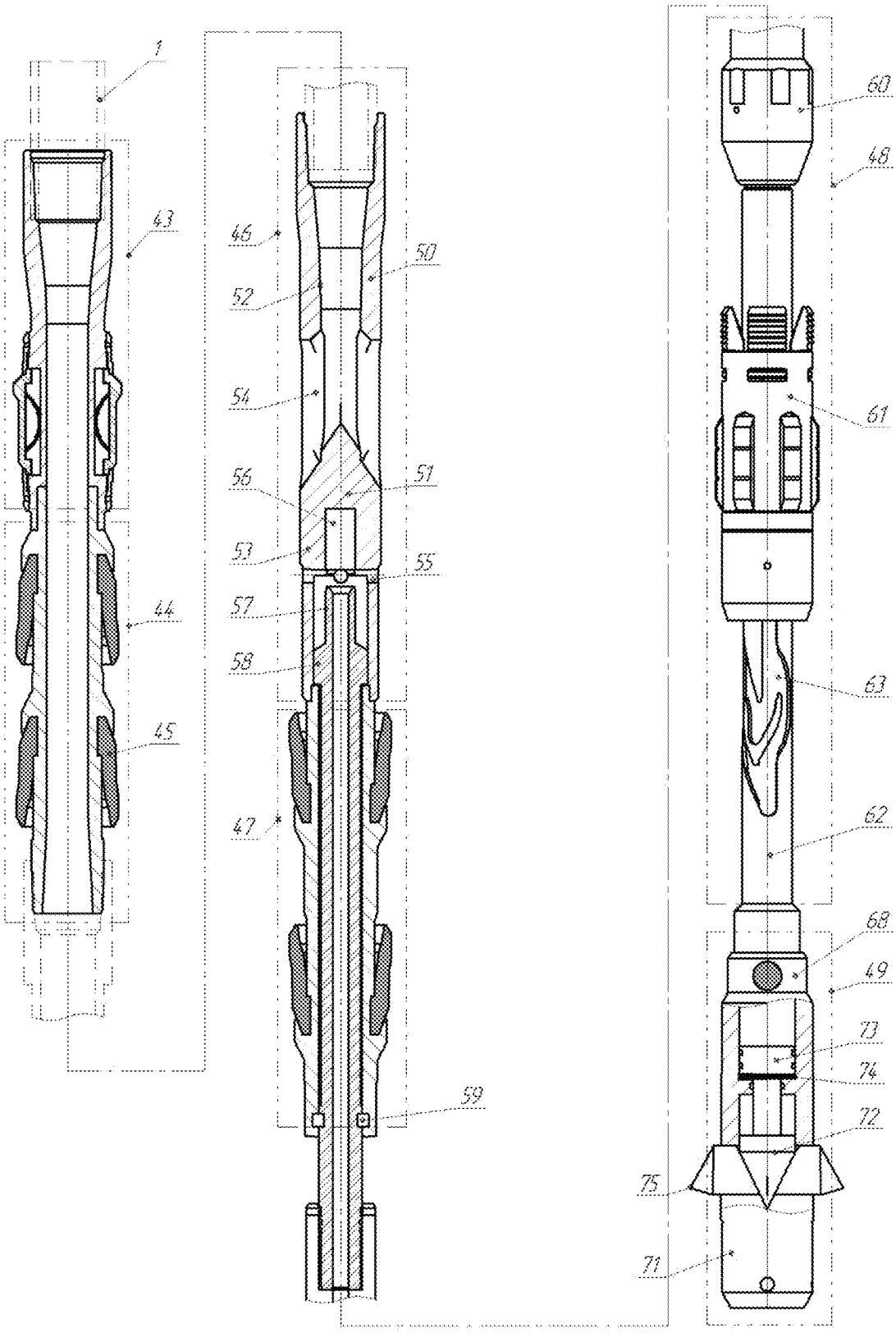
FIG. 14 shows a general view of the second version (axial section) of the device when perforating well casing.

The device is lowered into the well to the location of the perforator 49 at the level of the lowest interval. Axial movements of the device activate the mechanical anchor 48, while the pin 67 is in position 77. Under the weight of the tubing 1, the element 59 is destroyed, the lower packer 47 moves to the distance "S", and forms a tight contact with the pass-through mechanical anchor 48 (FIG. 13). To transfer the perforator to working position, the mechanical anchor 48 is deactivated by axial movements of the device, while the hollow rod 57 exits the recess 56, opening the holes 55. The device is brought to the perforation position (FIG. 14).

After that, the pump unit located on the surface supplies working fluid under pressure into the tubing 1. The working fluid, passing through the inner cavity of the tubing, enters the annulus through the windows 54 of the hydraulic fracturing port 46, while the cup sealing elements 45 are activated, maintaining the pressure of the working fluid in the inter-packer space. Working fluid through the holes 55 enters the inner cavity of the rod 57, the barrel 62 of the anchor 48 and the perforator 49, activating destructive elements 75 that perforate the well casing (FIG. 14).

Figure 15:
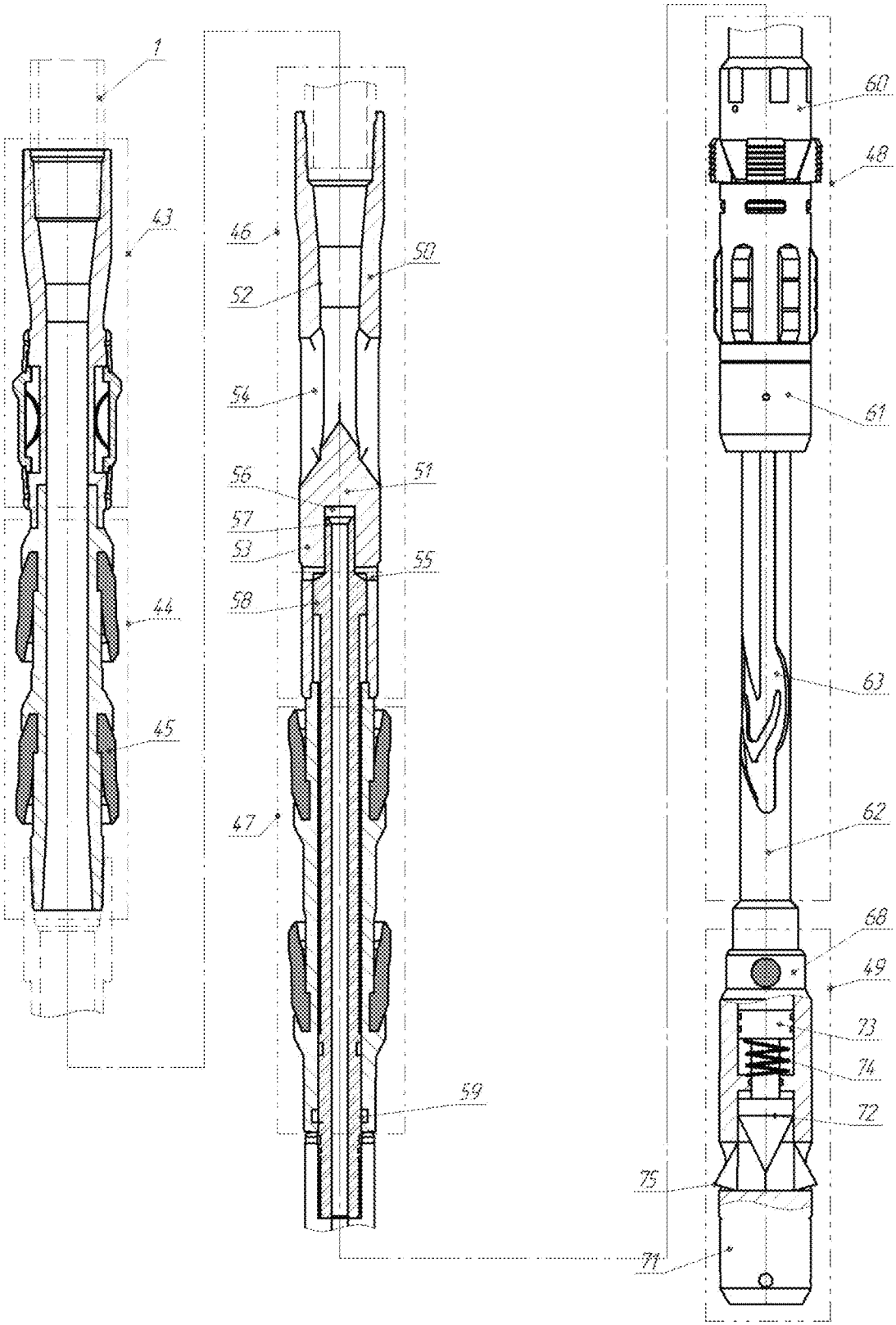
FIG. 15 shows a general view of the second version (axial section) of the device during hydraulic fracturing.

After the perforation, supply of the working fluid under pressure stops. The perforator is moved to the transport position and the upper and lower packers are deactivated. The device is lowered in the well to the level of perforated interval of the formation between the upper 43 and lower 47 packers. Then, the device is fixed in the well with the mechanical anchor 48. The rod 57 enters the recess 56 and overlaps the holes 55. The device is in the hydraulic fracturing position (FIG. 15).

Hydraulic fracturing fluid is supplied and, thanks to the counter flow from the port 46, the cup sealing elements 45 of the straight way packers 43 and 47 are opened and hermetically attached to the inner wall of the casing, insulating the inter-packer space. After that, hydraulic fracturing is performed.

After hydraulic fracturing, the pressure in the well is released, and the packers 43 and 47 are deactivated. Axial movement of the device brings the anchor 48 into the transport position.

In case of processing several intervals of the productive formation, the device is moved in the direction of the wellhead to the next interval and the method of selective processing is repeated in the above sequence of actions.

After completion of the perforation at the last interval of the productive formation, the pressure of the working fluid is increased to depressurize the element 68: destruction of the membrane 70 and opening of the hole 69. After that, hydraulic fracturing is performed and the device is lifted from the well. Fracking fluid is supplied from the inter-packer space, through the hole 55, the internal cavities of the rod 57, the anchors 48 and the hole 69 to the annulus space under the device, so that the elastic elements 45 of the lower packer 47 do not open, do not contact the casing when lifting the device from the well and are not subjected to additional loads.

INDUSTRIAL APPLICABILITY

A method for processing several intervals of a productive formation, in one tripping process using the FIRST or the SECOND version of the device is performed as follows.

As a result of studies of the productive formation, four intervals were determined that need to be processed using the proposed method. The lowest interval is located between 2,830-2,820 m; the next 2,765-2,750 m; then 2,703-2,693 m and the highest interval 2,632-2,620 m.

For processing, the version of the device is lowered into an inclined well with a production string with a diameter of 114 mm and a thickness of 7.5 mm (strength group "D" according to GOST 632), with a length of 2,850 m. The device is connected to a given interval of the productive formation by a mechanical collar locator. Then, the perforator 9 (49) is adjusted to the lowest interval to be processed.

The device is fixed in the well with the mechanical anchor 8 (48). Under the weight of the tubing 1, a tight contact of the main units located under the lower packer 6 (47) is secured.

Then, the working fluid is supplied and by activating the pass-through packers, the hydraulic connection of the tubing cavity with the annulus is provided through the holes of the hydraulic fracturing 14 (54).

Figure 10:
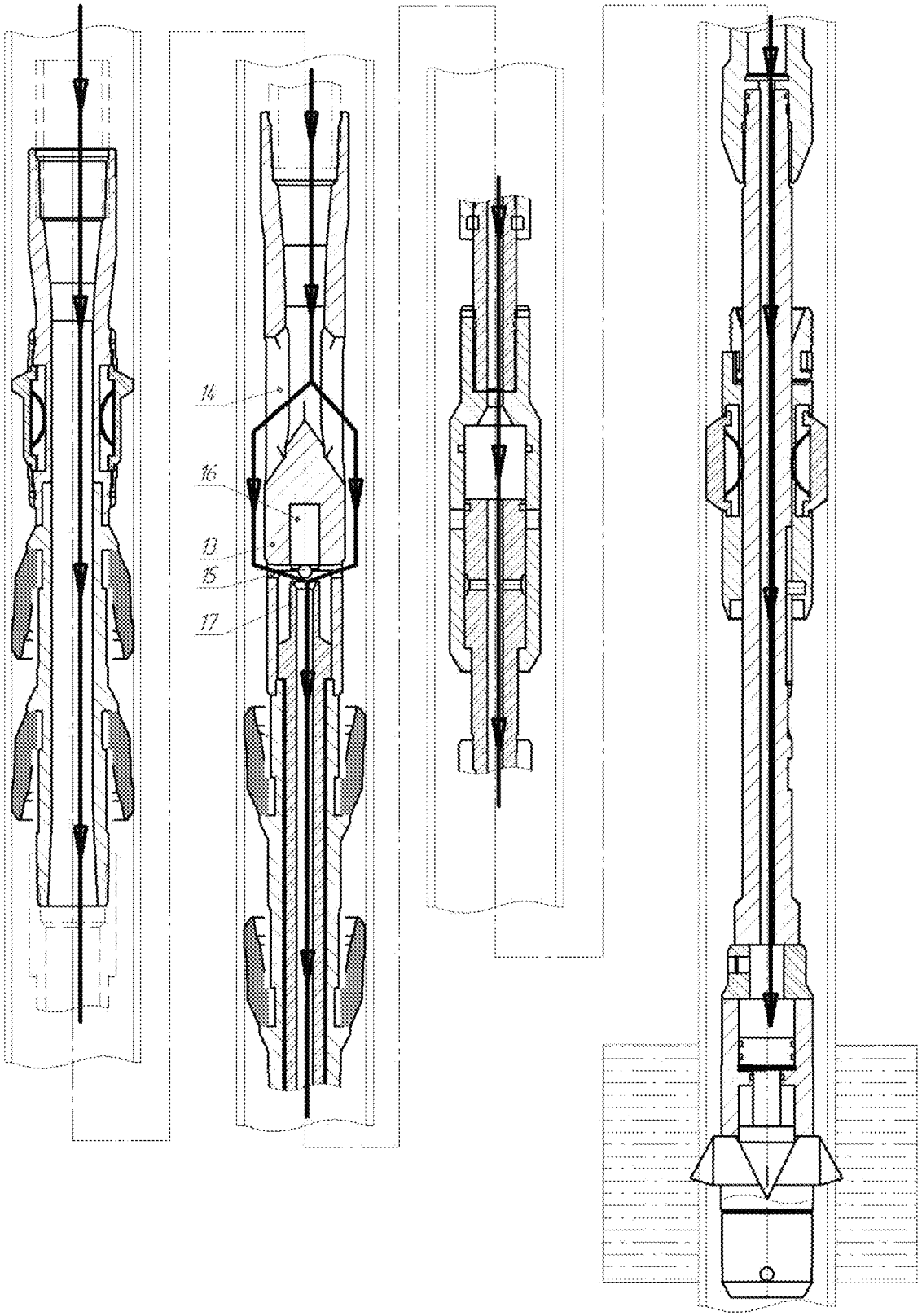
FIG. 10 shows an illustration of the working fluid flow during perforation of the interval of the productive formation using the first version of the device.
Figure 20:
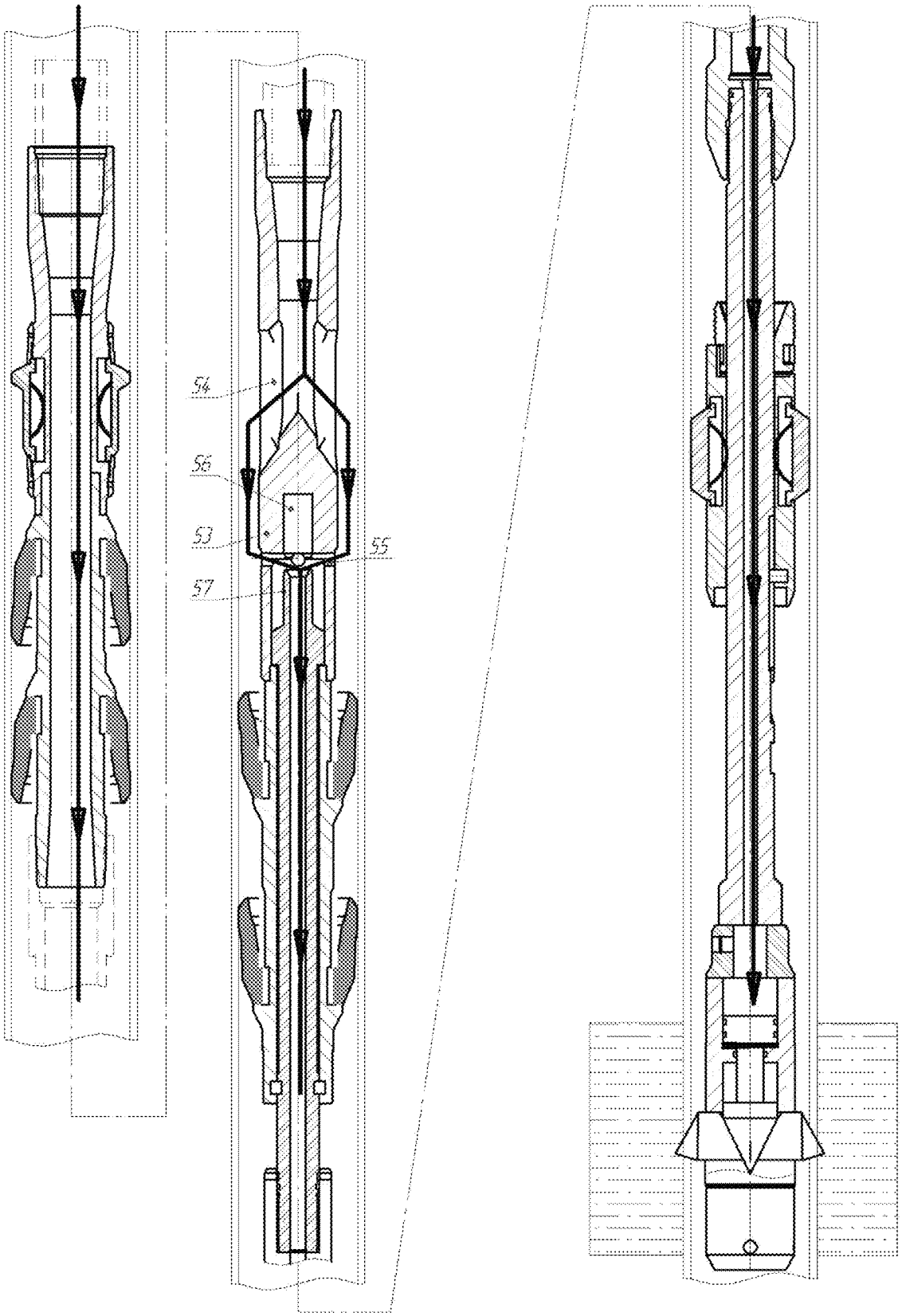
FIG. 20 shows an illustration of the working fluid flow during perforation of the interval of the productive formation using the second version of the device.

The mechanical anchor 8 (48) is deactivated and the working fluid is allowed to enter the inner space of the device under the lower pass-through packer. Working fluid is pumped under a pressure of 200 atm., and the perforator 9 (49) is brought into the working position, activating its destructive elements 19 (59). Perforation of the interval of the productive formation is performed (FIGS. 10 and 20).

Depending on the productive formation parameters, perforation can be performed several times within the same interval.

Upon completion of the perforation, the pressure of the working fluid is reduced, the pass-through packers are deactivated and the tubing 1 is lowered until the lowest perforation interval is between the pass-through packers. The device is fixed in the well, activating the mechanical anchor 8 (48), and block the access of the supplied fluid to the internal cavity of the device under the lower packer 6 (47).

Then, with a gradual increase in pressure, the hydraulic fracturing fluid is supplied to the tubing 1, the packers are activated, hermetically isolating the inter-packer annulus.

Figure 11:
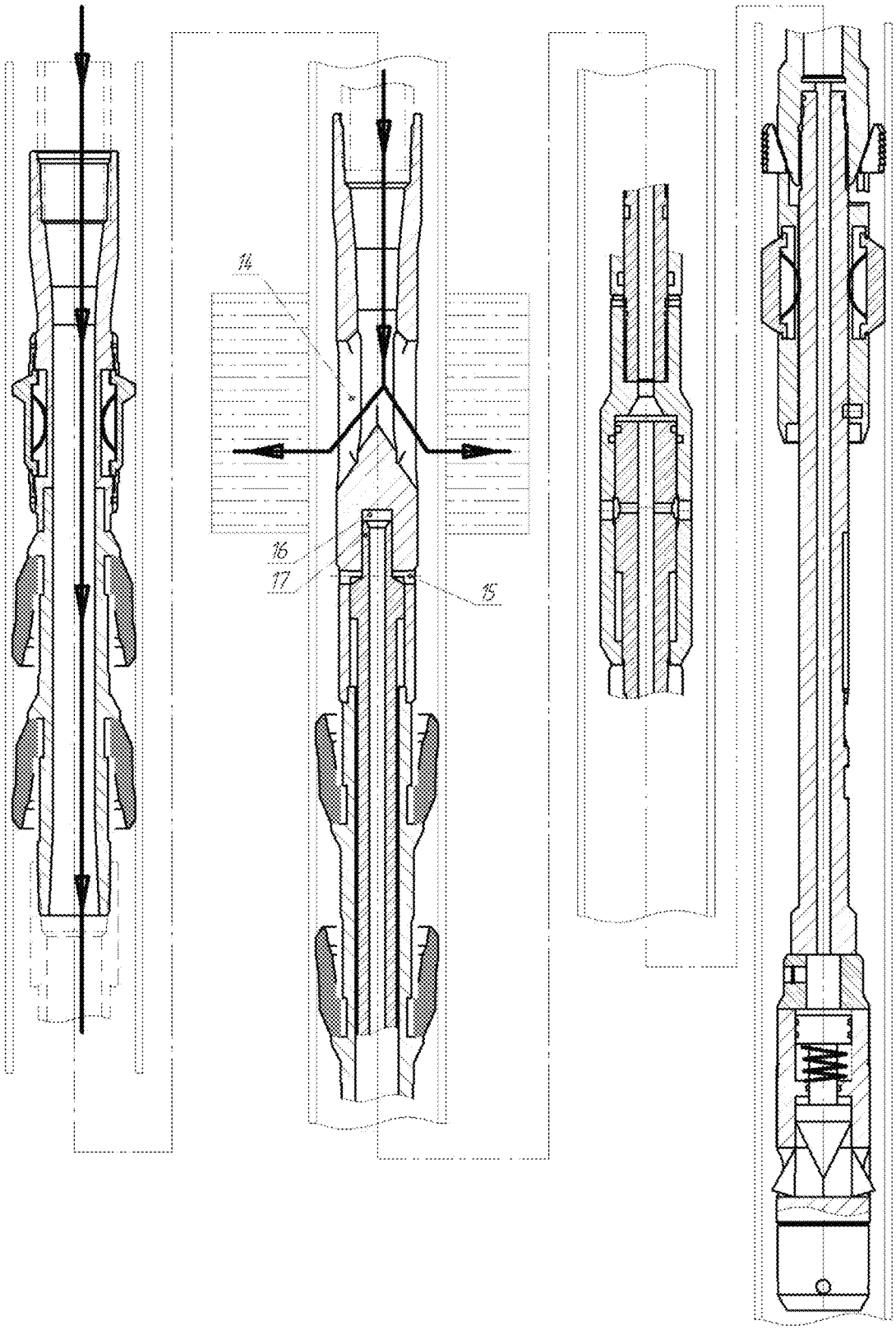
FIG. 11 shows an illustration of the supplied fluid flow during hydraulic fracturing using the first version of the device.
Figure 21:
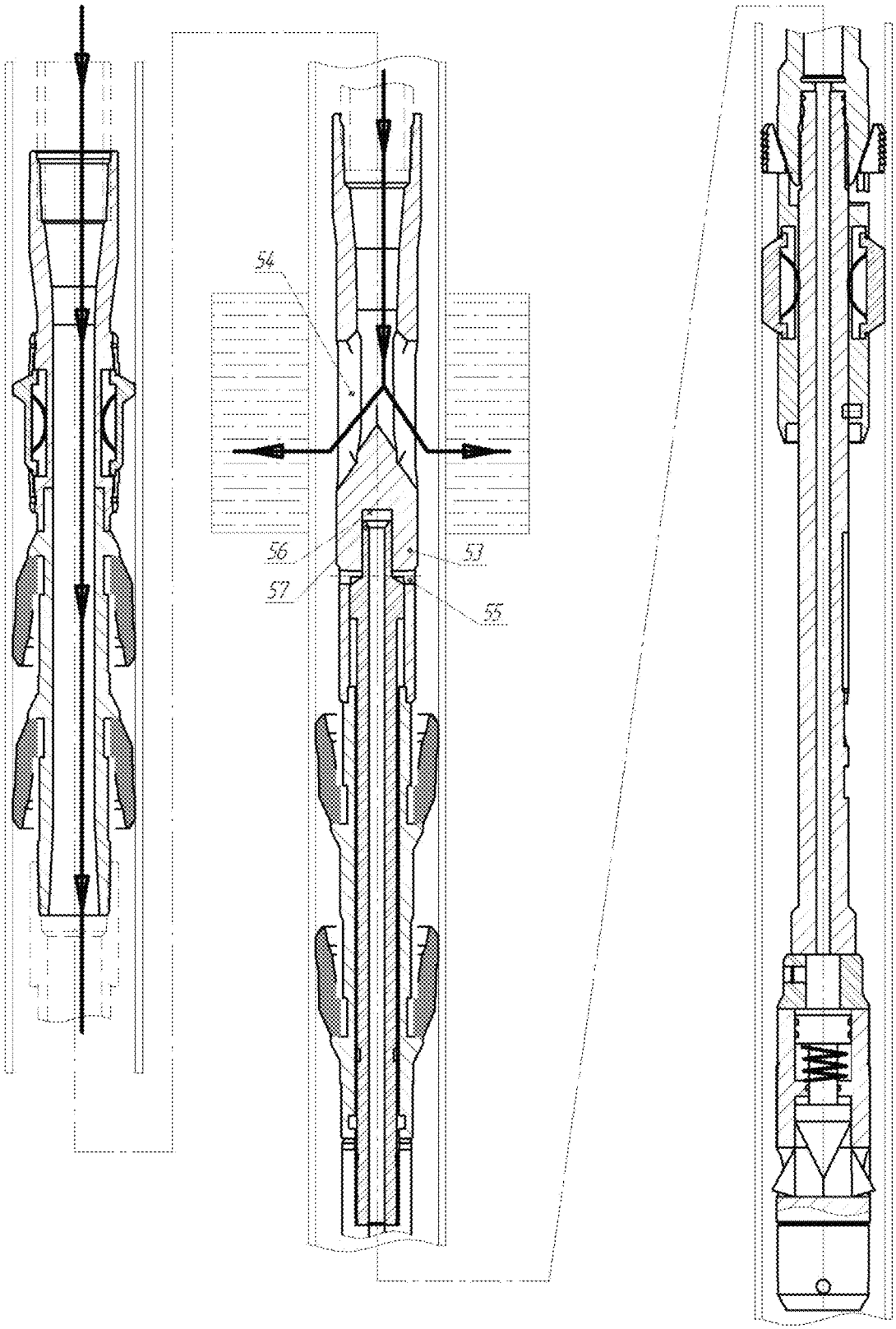
FIG. 21 shows an illustration of the working fluid flow during hydraulic fracturing using the second version of the device.

When the process pressure is reached, depending on the characteristics of the rock (up to 1,000 atm. with dense rock of deep level) through hydraulic fracturing holes 14, 54, hydraulic fracturing fluid is pumped into the perforated interval of the productive formation (FIGS. 11 and 21).

After the hydraulic fracturing performed in accordance with the technological plan, the pressure is released from the inter-packer space until the packers are brought to the transport position, the mechanical anchor 8 (48) is deactivated, allowing the device to move to the next interval of the productive formation, which is processed in the same sequence of actions.

When perforating the uppermost interval of the productive formation, working fluid is supplied at a pressure of 220 atm., while the membrane of the element 33 (68) located in the lower part of the device is destroyed.

After processing of all the intervals of the productive formation, the fluid supply is stopped, the packers and mechanical anchor are deactivated, the device is moved to the transport position and it is lifted out of the well casing.

The fracking fluid is discharged from the internal cavities of the device through the open holes of the membrane element.

The above described device versions and the method of processing several intervals of the productive formation in one tripping process allow for effective processing of each productive formation by ensuring trouble-free operation of a simple-designed device, which provides hermetic isolation of each interval of the productive formation and reliable fixation of the device in the well during hydraulic fracturing.

In addition, the proposed versions of the device allow for controlling the sequence of actions to activate the packers, anchors and perforators by simply moving the device into the well casing, which is efficient and convenient when processing productive formations in wells of various structures and lengths.

The invention claimed is:

1. A device essentially mounted on a tubing string insertable into a well casing associated with a productive formation; said well casing defines an inner sidewall surface thereof; said device defines an outer surface thereof; said device includes: an upper packer and a lower packer, wherein the lower packer defines an inner cavity thereof: an inter-packer annulus defined as a space between the outer surface of said device and the inner sidewall surface of said well casing, vertically limited by positions of the upper packer and the lower packer; and wherein the upper packer and the lower packer are configured for controllable separating and sealing the inter-packer annulus; an internal cavity located under the lower packer; a hydraulic fracturing port located between the upper packer and the lower packer, said hydraulic fracturing port is essentially coupled with the lower packer; said hydraulic fracturing port defines a port housing divided by a partition into a first portion and a second portion, wherein: fracturing holes are provided in the first portion, port radial holes are provided in the second portion and configured for providing controllable hydraulic communication of the internal cavity with the inter-packer annulus; a first hollow rod partially extending through the second portion and partially extending through the inner cavity of the lower packer; a valve located below the lower packer; said valve includes a valve housing provided with valve housing radial holes and a movable second hollow rod provided with valve rod radial holes; a mechanical anchor located below the lower packer; and a perforator being in controllable hydraulic communication essentially with the tubing string located below and rigidly coupled with the mechanical anchor.

2. The device according to claim 1, further including a mechanical collar locator located above the upper packer; and wherein the mechanical collar locator is configured for positioning the device in relation to an interval of the productive formation.

3. The device according to claim 1, wherein the upper packer and the lower packer further include cup-shaped sealing elements open toward the hydraulic fracturing port.

4. The device according to claim 1, wherein the first hollow rod is operatively coupled with the lower packer by a destructible element.

5. The device according to claim 1, wherein the second hollow rod further defines an upper portion thereof having an upper diameter and a lower portion thereof having a lower diameter being less than the upper diameter; and the second hollow rod is operatively coupled with the valve housing by a destructible element.

6. The device according to claim 1, wherein the second hollow rod further defines an upper portion thereof having an upper diameter and a lower portion thereof having a lower diameter being less than the upper diameter; and wherein the lower portion of the second hollow rod defines a stroke of the second hollow rod, when the port radial holes and the valve rod radial holes operatively overlap or coincide.

7. The device according to claim 1, wherein said second portion is made in the form of a partition cavity for accommodating the first hollow rod, providing for operatively overlapping the port radial holes for controllable separating the internal cavity from the inter-packer annulus.

8. The device according to claim 1, wherein said mechanical anchor further includes anchor elements and friction elements.

9. The device according to claim 1, wherein said device is so configured that a tight contact between the mechanical anchor, the lower packer, the valve and the first hollow rod is operatively established, upon fixing the device in the well casing with the mechanical anchor, and said tight contact is maintained till deactivating the mechanical anchor.

10. A device essentially mounted on a tubing string insertable into a well casing associated with a productive formation; said well casing defines an inner sidewall surface thereof; said device defines an outer surface thereof; said device includes: an upper packer and a lower packer, wherein the lower packer defines an inner cavity; an inter-packer annulus defined as a space between the outer surface of said device and the inner sidewall surface of said well casing, vertically limited by positions of the upper packer and the lower packer; and wherein the upper packer and the lower packer are configured for controllable separating and sealing the inter-packer annulus; an internal cavity located under the lower packer; a hydraulic fracturing port located between the upper packer and the lower packer, said hydraulic fracturing port is essentially coupled with the lower packer; said hydraulic fracturing port defines a port housing divided by a partition into a first portion and a second portion, wherein: fracturing holes are provided in the first portion, port radial holes are provided in the second portion and configured for providing controllable hydraulic communication of the internal cavity with the inter-packer annulus; a hollow rod partially extending through said second portion and partially extending through said inner cavity; a mechanical anchor located below the lower packer; and a perforator being in controllable hydraulic communication essentially with the tubing string, located below and rigidly coupled with the mechanical anchor.

11. The device according to claim 10, further including a mechanical collar locator located above the upper packer; wherein said mechanical collar locator is configured for positioning the device in relation to an interval of the productive formation.

12. The device according to claim 10, wherein the upper packer and the lower packer further include cup-shaped sealing elements open toward the hydraulic fracturing port.

13. The device according to claim 1, wherein the hollow rod is operatively coupled with the lower packer by a destructible element.

14. The device according to claim 10, wherein said second portion is made in the form of a partition cavity for accommodating the hollow rod, and operatively providing for overlapping the port radial holes for controllable separating the internal cavity from the inter-packer annulus.

15. The device according to claim 10, wherein said mechanical anchor further includes anchor elements and friction elements.

16. The device according to claim 10, wherein said device is so configured that a tight contact between the mechanical anchor, the lower packer and the hollow rod is operatively established, upon fixing the device in the well casing, and said tight contact is maintained till deactivating the mechanical anchor.

* * * * *